US005289637A

United States Patent [19]

Coffey

[11] Patent Number: 5,289,637

[45] Date of Patent: Mar. 1, 1994

[54] UTILITY KNIFE

[76] Inventor: John Coffey, Box 703, Shelter Island, N.Y. 11964

[21] Appl. No.: 857,320

[22] Filed: Mar. 25, 1992

[51] Int. Cl.[5] ..... B26B 11/00; B26B 3/00; B26B 29/00

[52] U.S. Cl. ..... 30/294; 30/233; 30/335

[58] Field of Search ..... 30/294, 233, 179, 335, 30/294, 233, 335; 7/112, 115, 163, 164

[56] References Cited

U.S. PATENT DOCUMENTS

| | | | |
|---|---|---|---|
| 170,570 | 1/1875 | Lamb | 30/233 |
| 180,633 | 8/1876 | Potter . | |
| 786,646 | 4/1905 | Johnson . | |
| 1,218,798 | 3/1917 | Nelson . | |
| 1,555,653 | 9/1925 | Frank . | |
| 1,684,566 | 9/1928 | Winkler . | |
| 1,843,535 | 2/1932 | Arnold . | |
| 2,023,408 | 12/1935 | Coll . | |
| 2,205,717 | 6/1940 | Fedon . | |
| 2,211,577 | 8/1940 | Muserlian . | |
| 2,952,025 | 9/1960 | Johnson . | |
| 4,255,856 | 3/1981 | Mackie | 7/163 |
| 4,759,441 | 7/1988 | Leurck . | |
| 4,766,673 | 8/1988 | Bolson . | |
| 4,776,096 | 10/1988 | Chang | 30/233 |
| 4,794,692 | 1/1989 | Wang | 7/163 |
| 4,866,847 | 9/1989 | Batrack et al. . | |
| 4,936,014 | 6/1990 | Shaanan et al. | 30/335 |
| 4,993,093 | 2/1991 | Goldwitz | 7/163 |

*Primary Examiner*—Richard K. Seidel
*Assistant Examiner*—Paul M. Heyrana
*Attorney, Agent, or Firm*—Dilworth & Barrese

[57] ABSTRACT

A utility knife for use in combination with the end of an extensible measuring tape. The utility knife includes an attachment having a slot for receiving the end hook of the tape, and a screw which can be turned to secure the end hook within the slot.

20 Claims, 2 Drawing Sheets

UTILITY KNIFE

BACKGROUND OF THE INVENTION

1. Field of the Invention

This invention relates to knives, and more particularly to a utility knife for cutting of sheet material such as plasterboard or the like.

2. Background of the Art

Plasterboard (often referred to as drywall or sheetrock) is sold in standard size sheets, typically of 4'×8' size. When plasterboard is installed as a wall cladding, it is often necessary to cut a strip of uniform width from a standard sheet, for example to provide a partial sheet for installation in a corner of a room. A professional installer will cut the strip using a utility knife in conjunction with a tape measure. Using his thumb, he will hold the end of the tape measure against the side of the utility knife, extend the tape across the sheet, and hold the tape reel against the edge of the sheet. With the reel held in one hand and the knife in the other, the installer will simultaneously slide both hands down the sheet so that the knife will score a line parallel to the edge. The tape measure is then set aside and a final cut is made along the score line using the knife. The strip to be cut off is then bent with respect to the remainder of the sheet until it snaps along the cut line. Generally, it would not be possible for the installer to apply sufficient pressure to the knife to make the required cut in one pass.

It will be appreciated that this operation is somewhat inconvenient and is time consuming in that two passes with the knife are required. If the installer presses too hard with the knife on the first pass, there is the risk that an inaccurate cut will be made or that the operator may injure himself on the knife blade. There is also the problem that the tape measure may slip.

U.S. Pat. No. 2,952,025 to Johnson, discloses a utility knife having a built-in tape measure for facilitating cutting of plasterboard sheets and the like in the manner discussed above. So far as is known, the Johnson device is not commercially available. However, it is thought that the device would be expensive to manufacture and somewhat cumbersome. Also, there would be the disadvantage that the tape measure could not conveniently be used other than in association with the knife.

U.S. Pat. No. 4,255,856 to Mackie discloses a utility knife attachment in the form of a thin metal plate which is fitted to the handle of the knife alongside the blade and which has a projecting flange at its outer end formed with a slot for receiving a measuring tape.

The following are other examples of patents relating to tape measures associated with scissors for facilitating similar cutting operations on fabrics and the like: U.S. Pat. Nos. 786,646 (J. Johnson); 1,218,798 (Nelson); 2,023,408 (Coll); 2,023,409 (Coll); 2,952,025 (F. H. Johnson).

There is yet a need for a simple but improved means for removably securing the end of a measuring tape to a utility knife.

SUMMARY OF THE INVENTION

A utility knife body is provided herein for receiving a cutting blade and for use in combination with a tape measure having an extensible tape end. The utility knife body comprises a handle portion for holding the cutting blade, and holding means attached to the handle portion for releasably securing the end of the tape. The holding means includes means for receiving the end of the tapes and securing means for releasably securing the end of the tape to the handle of the utility knife body. The securing means may be movable between a first position for rigidly locking the end of the tape within the receiving means and a second position wherein the end of the tape is releasable from the receiving means. The holding means optionally comprises a body portion, and the receiving means can be a slot in the body portion. The slot is oriented parallel to the lengthwise orientation of the handle portion. The means is movable in a direction substantially perpendicular to a plane defined by the knife blade.

BRIEF DESCRIPTION OF PREFERRED EMBODIMENTS(S)

Figure 1:
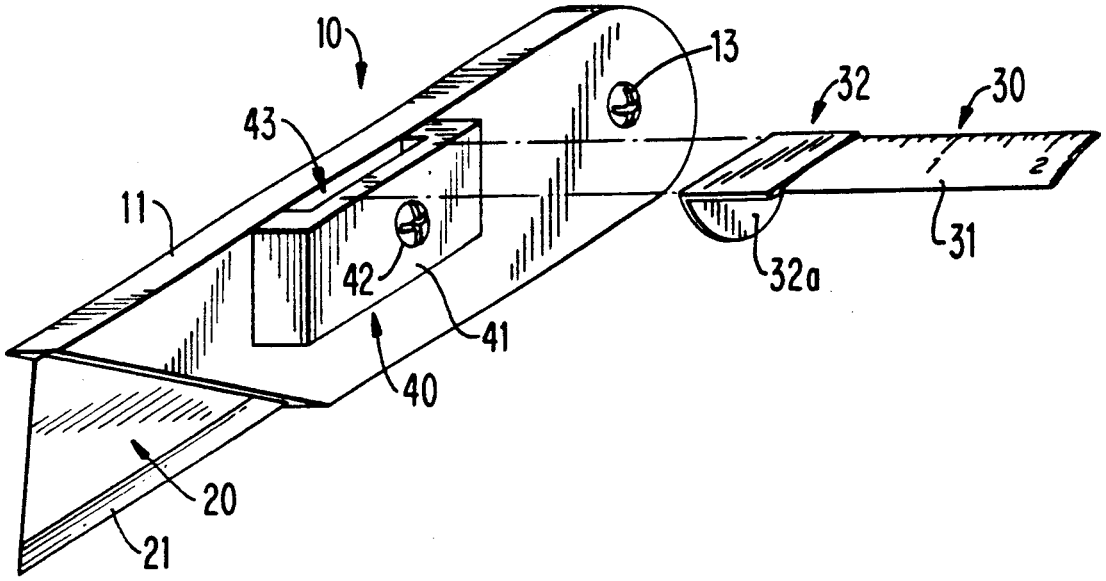
FIG. 1 is a perspective view showing the utility knife of the present invention in conjunction with a tape measure.

Referring to FIG. 1, the utility knife 10 of the present invention comprises a handle portion 11 for holding a cutting blade 20 having a sharp cutting edge 21. The blade may or may not be retractable and/or replaceable. The handle may be of integral construction or constructed of separable halves which are assembled with the knife blade 20 in between. The handle may be fabricated from any suitable metal, or from a durable polymeric material. A screw 13 may be used to secure the halves and/or the knife blade.

The utility knife 10 is used in conjunction with tape measure 30 having a blade-like measuring tape 31 with length indicating numerals marked thereon. Such tape measures are conventionally wound on reels in a rotatable mounting within a generally box shaped housing. The tape measure is extendable from the housing and usually is resiliently biased to return to the housing. The tape measure rewinds if no pulling force is exerted upon it to keep it extended, unless a locking feature is activated to keep the tape fixed at a desired extension. The end of the tape measure 30 usually includes an end hook 32 having a tab **32*a* bent at about a right angle from the tape 31. The actual construction of the tape measure is not critical to the utility knife of the present invention provided that the end of the tape can be received by the holding means 40** on the utility knife.

The utility knife 10 of the present invention possesses holding means 40 fixedly attached to the handle portion 11 for releasably securing the end hook 32 of the tape measure 30. The holding means 40 includes a body portion 41, which may be fixedly attached to handle 11 by any suitable means, such as by the use of fasteners, adhesives, welding, or the like. Alternatively the body portion 41 and handle 11 may be integrally constructed as a single piece, such as, for example, by molding, casting, or the like.

Body member 41 includes means for receiving the end of tape measure 30. To that end, slot 43, which is preferably oriented parallel to the lengthwise orientation of the handle portion, is configured and dimensioned to receive tab **32*a*. Other means for receiving the end of a tape measure may be employed in place of slot 43, depending on the structure, if any, located at the end of the tape 30**. Such alternative configurations may include one or more holes of circular or other shape, or slots of irregular shape or other orientations.

Figure 2:
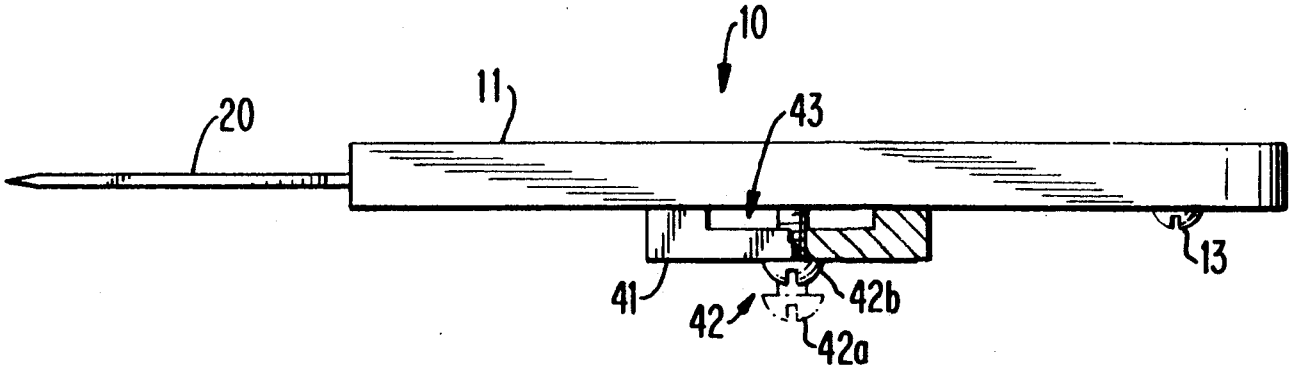
FIG. 2 illustrates a partly sectional plan view of the utility knife.

Referring to FIG. 2 in conjunction with FIG. 1, screw 42 constitutes securing means for releasably securing the end of the tape directly to the handle of the utility knife. Screw 42 is disposed through a corresponding threaded aperture in body portion 41. When tab 32*a* is inserted into slot 43, screw 42 is turned clockwise so as to advance inwardly from a first outer position 42*a* (shown in phantom lines in FIG. 2) towards handle 11 to a second inner position 42*b*, thus tightening upon tab 32*a* and frictionally engaging and locking tab 32*a* securely within slot 43 such that tab 32*a* cannot easily be dislodged by the usual handling occurring during carpentry and constructions operations. When the carpenter is finished, the tape measure is easily released by turning screw 42 counterclockwise.

Other means may be employed for releasably securing the end of the tape to the handle, provided the tape cannot be easily dislodged from the receiving means but can, when desired, be removed from the receiving means. For example, a leaf spring may be disposed in slot 43 to frictionally engage a structure located on the end of the tape. As another example, a vise-like structure which can be tightened by a latch or screw mechanism may secure the tape to the handle. This embodiment is particularly useful where there is no end hook on the tape. In this case, the faces of the vise-like structure form a slot generally perpendicular to the orientation of the blade and the end of the tape is received in the slot.

Body member 41 includes means for receiving the end of the tape measure 30. For this purpose, slot 43, which is preferable oriented parallel to the lengthwise orientation of the handle portion, is configured and dimensioned to receive tab 32*a*.

Referring to FIG. 2 in conjunction with FIG. 1, screw 42 is disposed through a corresponding threaded aperture in body portion 41. When tab 32*a* is inserted into slot 43, screw 42 is turned clockwise so as to advance inwardly from a first outer position 42*a* towards handle 11 to a second inner position 42*b*, thus tightening upon tab 32*a* and frictionally engaging and locking tab 32*a* securely within slot 43 such that tab 32*a* cannot easily be dislodged by the usual handling occurring during carpentry and constructions operations. When the carpenter is finished, the tape measure is easily released by turning screw 42 counterclockwise.

Depending on the configuration of the utility knife the end of the tape may not exactly correspond to the cutting line created by the knife. Thus, the utility knife should be dimensioned such that a known and easily added correction factor, (e.g., a distance of, for example, ¼ inch or ⅛ inch) can be added by the user to determine the true distance.

Figure 3:
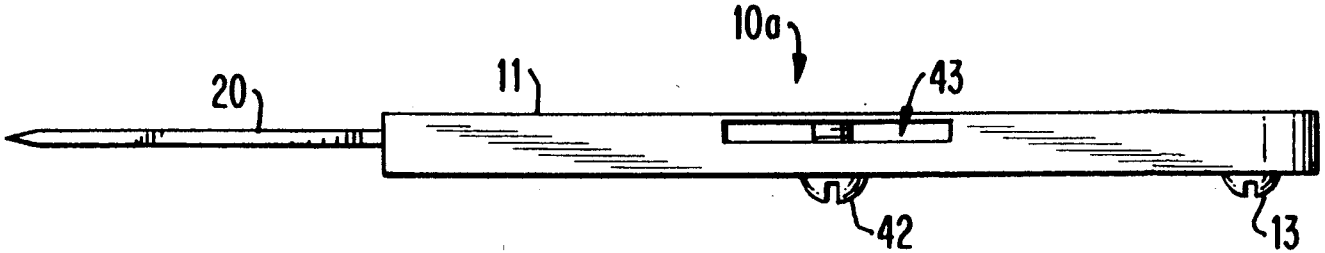
FIG. 3 illustrates a top view of an alternative embodiment of the utility knife.

Alternatively, the utility knife may be constructed such that the end of the tape corresponds to the knife edge, thereby obviating the need for adding a correction factor. FIG. 3 illustrates an alternative embodiment 10*a* of the utility knife wherein the body portion 41 is excluded, and slot 43 is located in the top of the handle 11 and is positioned such that the end of the tape is aligned with the edge of knife 20. Screw 42 is mounted to the handle for securing the tab 32*a* to the handle 11.

While the above description contains many specifics, these specifics should not be construed as limitations on the scope of the invention, but merely as exemplifications of preferred embodiments thereof. Those skilled in the art will envision many other possible variations that are within the scope and spirit of the invention as defined by the claims appended hereto.

What is claimed:

1. A utility knife body for receiving a cutting blade and for use in combination with a tape measure having a tape with an extensible end portion, which comprises:

a) a handle portion for holding a planar cutting blade along a lengthwise axis of the handle portion;

b) holding means attached to the handle portion for attaching the extensible end portion of the tape directly to said handle, said holding means having means for receiving the extensible end portion of the tape and movable securing means for releasably securing the extensible end portion of the tape directly to said handle, said means for receiving the extensible end portion of the tape being laterally offset from the lengthwise plane in which the cutting blade is oriented.

2. The utility knife body of claim 1, wherein said extensible end portion of the tape includes an end hook.

3. The utility knife body of claim 2, wherein said movable securing means for releasably securing the extensible end portion of the tape includes means movable between a first position for rigidly locking said end hook within said means for receiving the extensible end portion of the tape, and a second position wherein the end hook is releasable from said means for receiving the extensible end portion of the tape.

4. The utility knife body of claim 3, wherein said movable means is movable in a direction substantially perpendicular to a plane defined by the cutting blade.

5. The utility knife body of claim 4, wherein said movable means comprises a screw.

6. The utility knife body of claim 3, wherein said movable means comprises a screw and said screw is disposed within a threaded aperture in the body portion of said holding means and oriented substantially perpendicular to the orientation of said slot.

7. The utility knife body of claim 1, wherein said holding means comprises a body portion and said means for receiving the extensible end portion of the tape is a slot in said body portion.

8. The utility knife body of claim 7, wherein said slot is oriented parallel to the lengthwise orientation of the handle portion.

9. The utility knife body of claim 1, wherein said utility knife body is fabricated from metal.

10. The utility knife body of claim 1, wherein said utility knife body is fabricated from a polymeric material.

11. The utility knife body of claim 1, wherein said holding means and said utility knife body are integrally constructed as a single piece.

12. A utility knife body for receiving a cutting blade and for use in combination with a tape measure having an extensible tape with an end hook, which comprises:

a) a handle portion for holding a planar cutting blade along a lengthwise axis of the handle portion; and b) holding means fixedly attached to the handle portion for releasably securing the end hook of the tape, said end hook holding means including first means for receiving the end hook, and second means movable between a first position for rigidly locking the end hook within said first means and a second position wherein the end hook is releasable from said first means, said end hook being held in a position laterally offset from the lengthwise plane in which the cutting blade is oriented.

13. The utility knife body of claim 12, wherein said holding means comprises a body portion and said first means is a slot in said body portion.

14. The utility knife body of claim 13, wherein said slot is oriented parallel to the lengthwise orientation of the handle portion.

15. The utility knife body of claim 13, wherein said second means comprises a screw and said screw is disposed within a threaded aperture in the body portion of said holding means and oriented substantially perpendicular to the orientation of said slot.

16. The utility knife body of claim 12, wherein said second means is movable in a direction substantially perpendicular to a plane defined by the cutting blade.

17. The utility knife body of claim 12, wherein said second means comprises a screw.

18. The utility knife body of claim 12, wherein said utility knife body is fabricated from metal.

19. The utility knife body of claim 12, wherein said utility knife body is fabricated from a polymeric material.

20. The utility knife body of claim 12, wherein said holding means and said utility knife body are integrally constructed as a single piece.

* * * * *